United States Patent [19]

Marsman et al.

[11] 4,072,232

[45] Feb. 7, 1978

[54] PACKAGE FOR MULTIPLE CONTAINERS

[75] Inventors: John W. Marsman, Pokagon Township, Cass County, Mich.; G. Norman Heaton, Elkhart, Ind.

[73] Assignee: Victor Comptometer Corporation, Chicago, Ill.

[21] Appl. No.: 712,028

[22] Filed: Aug. 5, 1976

[51] Int. Cl.[2] ..... B65D 5/54; B65D 17/20; B65D 85/54

[52] U.S. Cl. ..... 206/602; 206/606; 206/608; 206/806; 229/9; 229/14 BE

[58] Field of Search ..... 206/44 R, 44.12, 45.12, 206/459, 491, 498, 526-527, 806; 220/8; 229/9, 19, 23 BT, 40, 14 BE, 14 BW, 51 TS

[56] References Cited

U.S. PATENT DOCUMENTS

| | | | |
|---|---|---|---|
| 2,729,326 | 1/1956 | Stadnyk | 206/44.12 |
| 3,148,770 | 9/1964 | Cosman | 206/526 X |
| 3,187,889 | 6/1965 | Sinclair | 206/44.12 X |
| 3,313,407 | 4/1967 | Palm, Jr. | 206/526 X |
| 3,326,364 | 6/1967 | Waldrop et al. | 229/51 TS X |
| 3,375,968 | 4/1968 | Weiss | 206/498 X |
| 3,458,109 | 7/1969 | Compton et al. | 206/498 X |
| 3,721,339 | 3/1973 | Seyer | 206/498 |
| 3,952,872 | 4/1976 | Consiglio, Jr. | 206/526 |

*Primary Examiner*—Steven E. Lipman
*Attorney, Agent, or Firm*—Blanchard, Flynn, Thiel, Boutell & Tanis

[57] ABSTRACT

A package for shipping and dispensing articles, said packages having one substantially rectangular sleeve slidably disposed within another rectangular sleeve. The inner sleeve is structured to surround and hold a plurality of elongated articles, such as containers, which containers each have a tab at one end thereof with an opening therethrough for reception of an elongated element. With the outer sleeve removed from the inner sleeve, an end flap on the inner sleeve is bent away therefrom so that the elongated element can be inserted through the aligned openings in the tabs. One wall of the inner sleeve has a tear strip therein which can be removed so as to sever the inner sleeve, whereby the inner sleeve can be removed laterally away from the containers.

13 Claims, 7 Drawing Figures

PACKAGE FOR MULTIPLE CONTAINERS

FIELD OF THE INVENTION

This invention relates in general to a combined package and loading device in which plural containers or articles can be shipped and, more particularly, to a type thereof whereby the containers can be loaded on a rack of the type having an elongated support element from which the containers are suspended, after which the package is removed laterally from the containers or article.

BACKGROUND OF THE INVENTION

It is known to utilize racks for the display of high volume, packaged articles, particularly in semi-self-service retail outlets. A proper rack for this purpose is comprised of one or more elongated, relatively stiff upright supports on which are mounted a plurality of elongated cantilevered support rods, which rods project substantially horizontally from the upright supports. Usually, an article or its container or support is provided with an opening through which the rod extends for supporting the article in a suspended condition. Heretofore, it has been customary to manually mount the article supports or containers on the rods one at a time, and this is not only time consuming, but often leads to mistakes. That is, several different articles may be inadvertently mounted upon the same rod.

Furthermore, the individual handling of each article support or container increases the chance of damaging or soiling the support or container, or even its contents. In addition, the shipment of the goods to the dealer according to present procedures often results in difficult inventory control problems. That is, a dealer must make special efforts and keep special records of inventory control.

A primary object of this invention is the provision of a package for a plurality of elongated articles wherein said articles can be stored and shipped and from which said articles can be dispensed as a group, as for the purpose of mounting them upon a single hanger rod.

A further object of this invention is the provision of a package, as aforesaid, which snugly but removably holds said articles in selected relative positions and contains openings through which indicia on said articles or one of them can be viewed for the purpose of determining the nature of said articles without removing said package therefrom.

Other objects and purposes of this invention will become apparent to persons familiar with this type of packaging upon reading the following description and examining the accompanying drawings.

Figure 2:
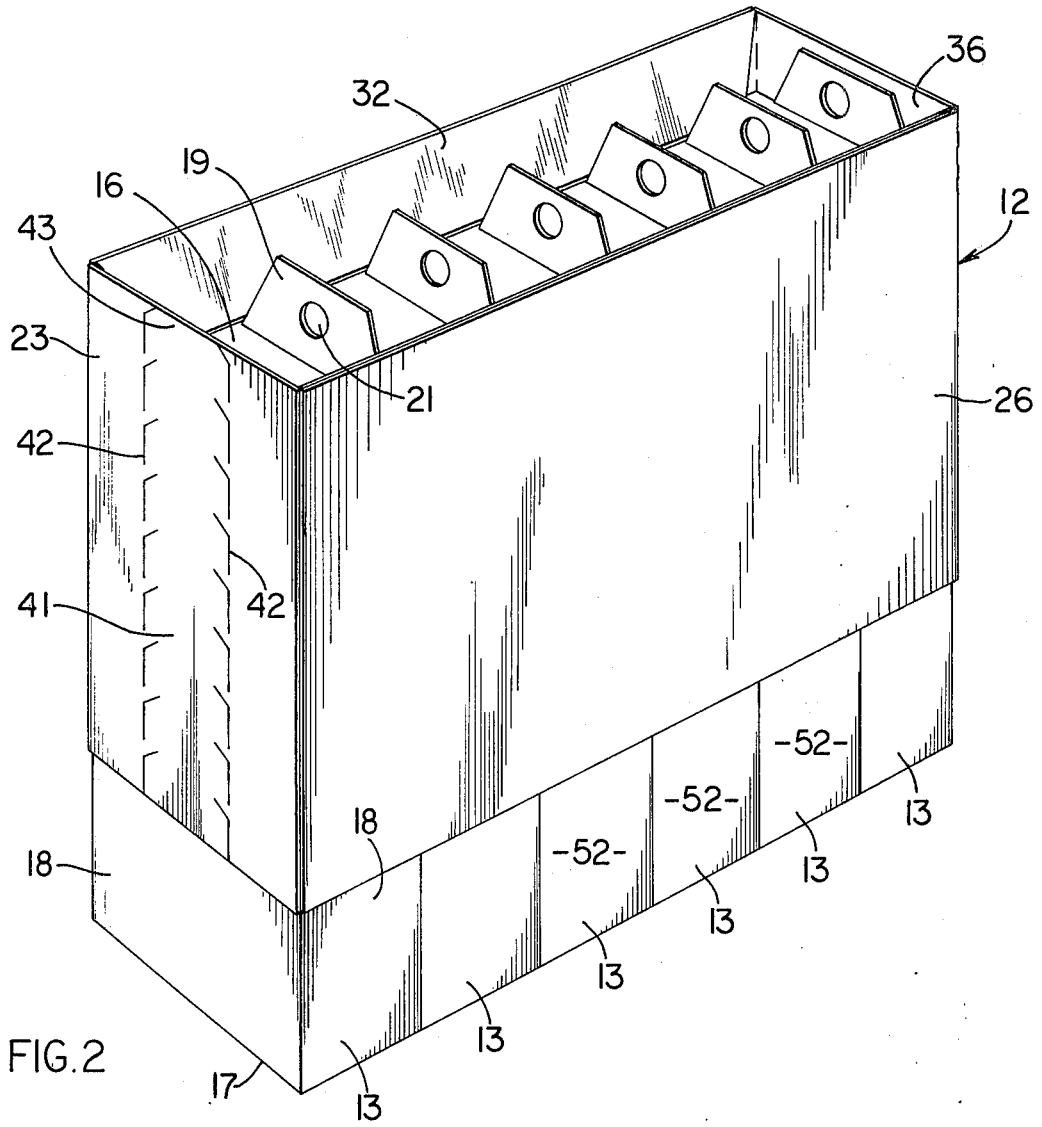
FIG. 2 is a perspective view of the package with the outer sleeve removed.

For convenience in description, the terms "upper", "lower", "front" and "rear" and words of similar import will have reference to the package of the invention as appearing in FIG. 2, the leftward end of the package in FIG. 2 being the front end. The words "inner", "outer" and derivatives thereof will have reference to the geometric center of the package and components thereof.

SUMMARY OF THE INVENTION

The objects and purposes of the invention, including those set forth above, have been met by providing a package comprised of a pair of rectangular sleeves telescopically engaged with the open end axes extending transversely of each other. The sleeves define a package in which a plurality of elongated articles are snugly disposed in lateral alignment. By removing the outer sleeve, aligned openings in the articles are readily exposed so that an elongated element, such as a rod, can be slidably received therethrough. Means on the inner sleeve are engageable with the ends of the articles adjacent said elongated element and obstruct slidable movement of the inner sleeve away from said element. Separation means, such as a tear strip, extends from one axial end to the other axial end of the inner sleeve to permit severing of the inner sleeve so that it can be removed laterally from the articles.

DETAILED DESCRIPTION

Figure 1:
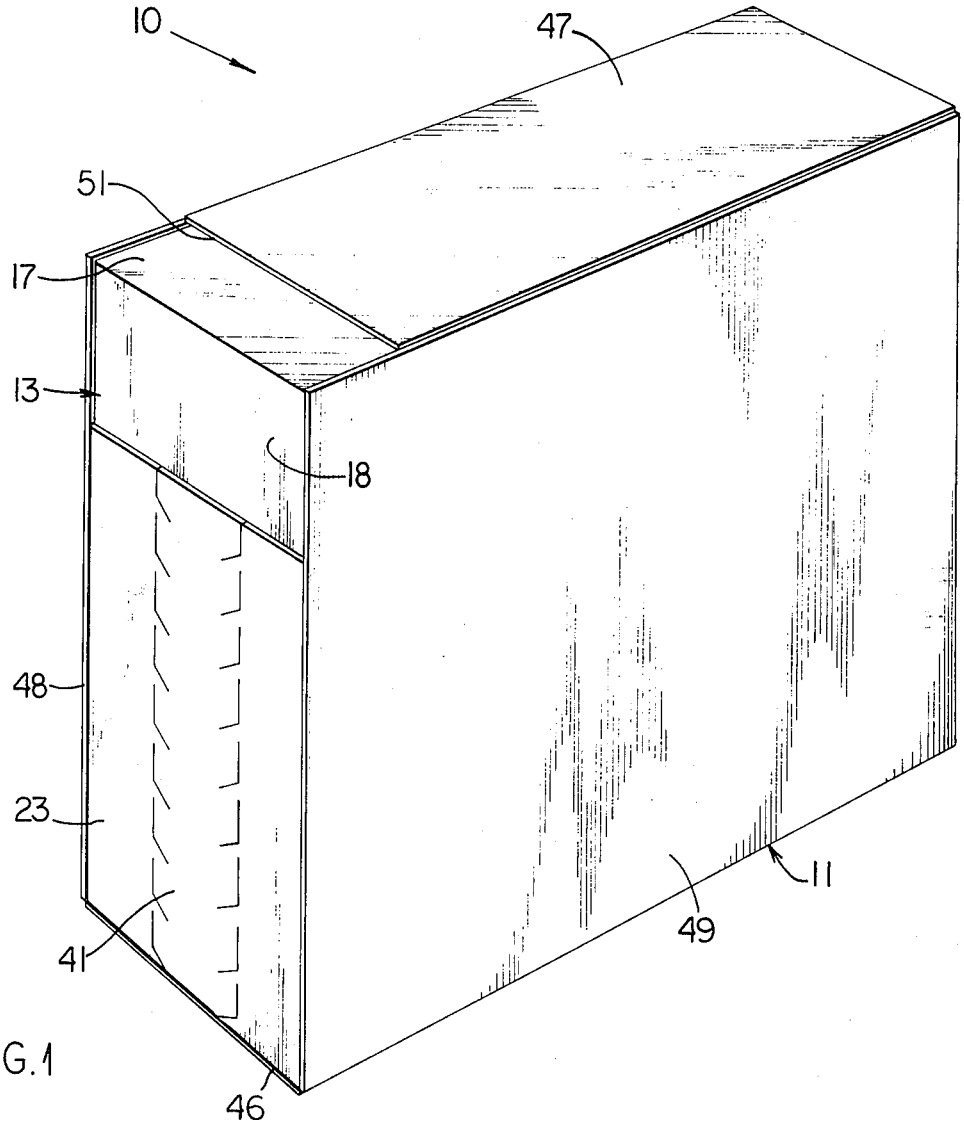
FIG. 1 is a perspective view of a package embodying the invention.

The package 10 of the invention, a preferred embodiment of which is disclosed in FIG. 1, is comprised of an outer sleeve 11 which telescopes over an inner sleeve 12 to form a container in which a plurality of elongated articles, such as the six boxes 13 shown in FIG. 2, are snugly held.

Each box 13 has an upper end wall 16, a lower end wall 17 and four rectangular side walls 18 extending therebetween. A quadrilateral tab 19 is rigidly secured to the upper end of each box and, in this embodiment, is in effect an upward coplanar extension of one side wall of the box. Each tab 19 preferably has a central opening 21 therethrough. The openings 21 in the tabs 19 of a group of boxes 13 are axially aligned when said boxes are aligned and their upper walls 6 are substantially coplanar, as shown in FIGS. 2 and 3.

Figure 6:
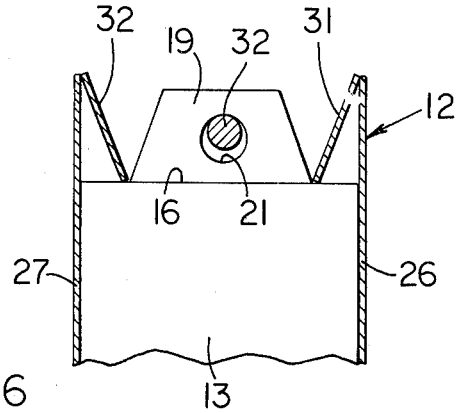
FIG. 6 is a fragmentary sectional view taken along line VI—VI in FIG. 2.
Figure 7:
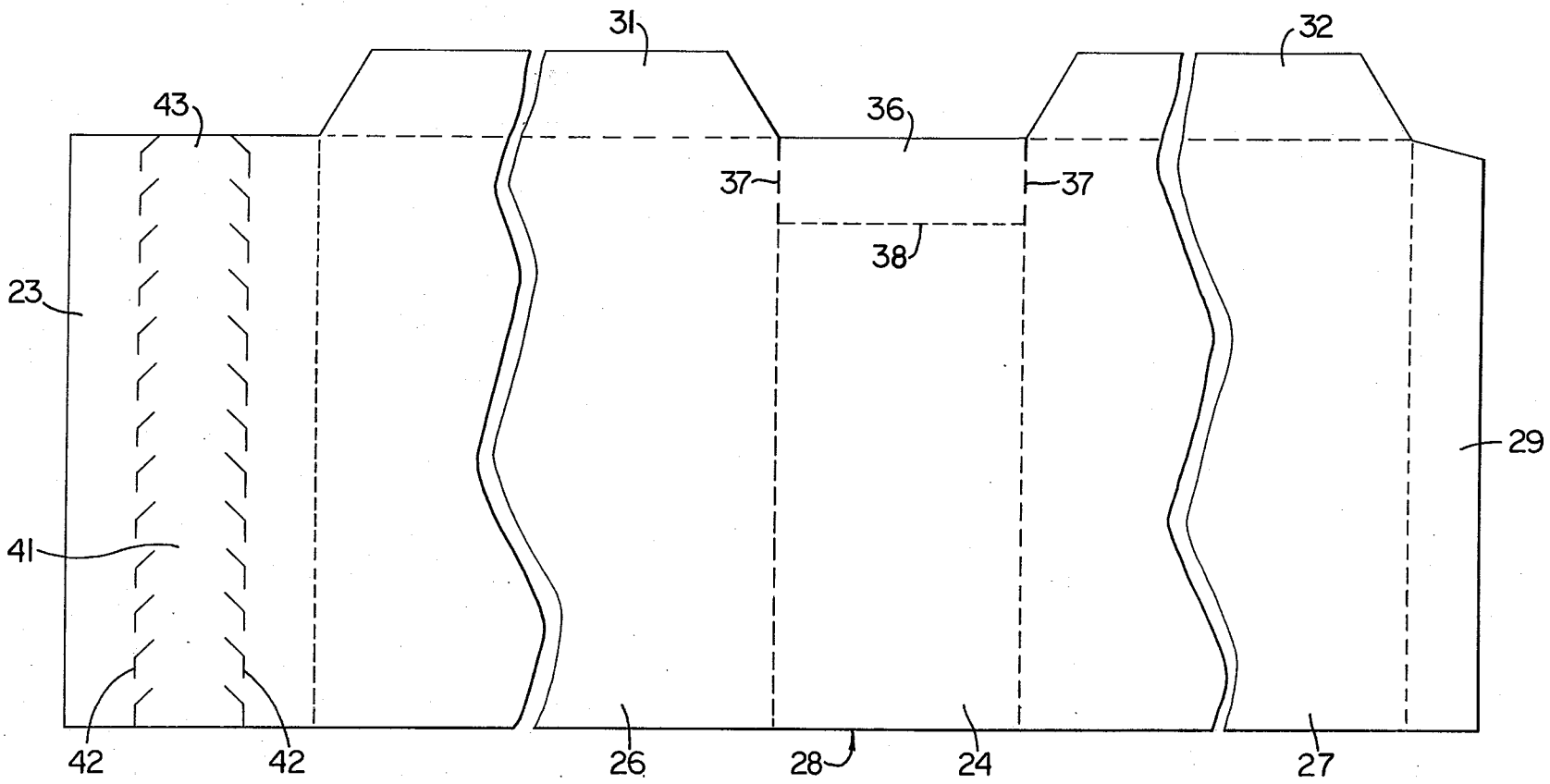
FIG. 7 is a broken view of the inner sleeve of the package shown as a flat blank.

The plurality of boxes 13, when in the aligned or stacked condition shown in FIG. 2, are held together by means of the inner sleeve 12 which is disposed in surrounding relationship thereto. The inner sleeve 12 is of a substantially rectangular cross-section and includes substantially parallel front and rear end walls 23 and 24, respectively, which walls are joined together by substantially parallel side walls 26 and 27. The inner sleeve 12 is initially formed as a flat blank 28 as shown in FIG. 7, which blank is normally stamped from a single sheet of semi-stiff paperboard or the like. The side wall 27, in this embodiment, has an integral glue strip 29 which overlays an edge portion of the front end wall 23 (FIG. 4) for permanent attachment thereto by any conventional adhesive. The blank 28 also has a pair of hold-down flaps 31 and 32 secured to and extending outwardly away from the upper ends of the side walls 26 and 27, respectively, which hold-down flaps 31 and 32 are normally folded downwardly and inwardly within the sleeve 12 in the manner illustrated in FIGS. 2, 3 and 6 so that the hold-down flaps overlie the boxes 13 and effectively abut against the upper walls 16 of the boxes on opposite sides of the tabs 19.

As illustrated in FIG. 2, the inner sleeve 12 has a length, as measured parallel to the axis which extends between the open ends of the sleeve, which is less than the overall length of the boxes 13. The lower ends of the boxes 13 thus project downwardly below the lowermost edge of the inner sleeve 12. The upper ends of the boxes, however, and particularly the tabs 19 are disposed entirely within the inner sleeve 12. The projecting lower portions of the boxes 13 permit the content of the boxes 13 to be readily observed and the exposed lower portion of the side walls of the boxes permit pricing or other marketing information to be easily stamped or labeled on the boxes while they are still effectively confined by the inner sleeve.

Figure 3:
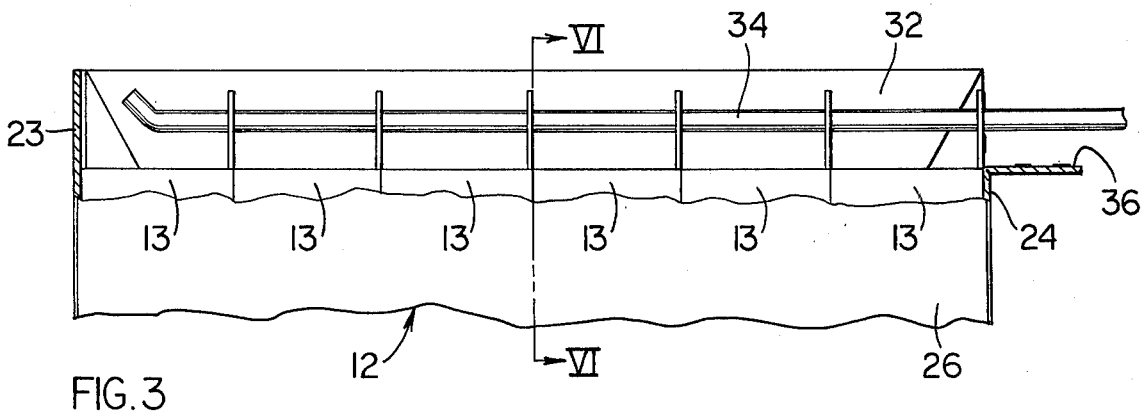
FIG. 3 is a fragmentary side view of the upper end portion of the package, as shown in FIG. 2, with the upper end of the inner sleeve removed.
Figure 4:
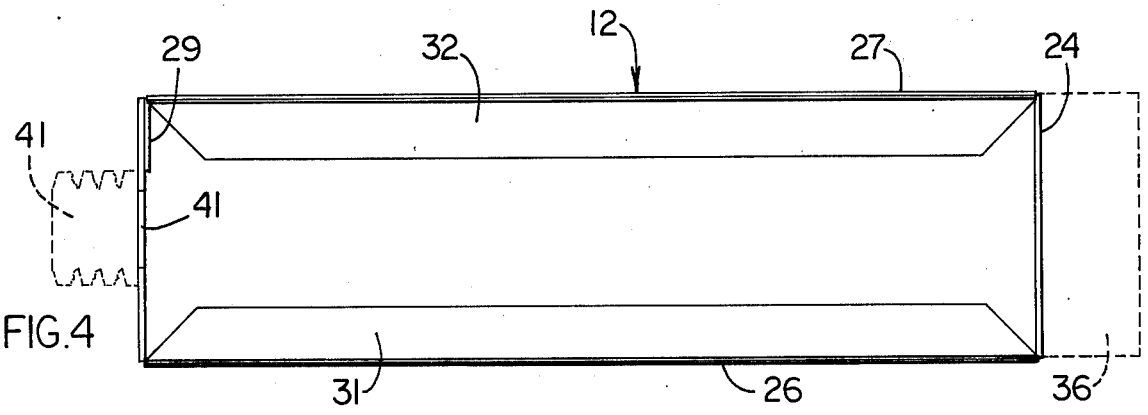
FIG. 4 is a top view of the package with the outer sleeve removed.

To facilitate the mounting of the plurality of boxes 13 on a hanger rod 34, as shown in FIG. 3, the rear end wall of inner sleeve 12 has a foldable flap 36 formed at the upper end thereof, which flap 36 is joined to the adjacent side walls 26 and 27 by perforated tear lines 37 and is also joined to the rear end wall 24 by a tear or fold line 38, which line 38 is disposed substantially coplanar with the top walls 16 of the boxes 13. The flap 36 can be folded outwardly and downwardly into the position illustrated in FIG. 3 when it is desired to insert the rod 34 through the aligned openings 21.

The front end wall 23 of inner sleeve 12 also has a separating structure associated therewith for permitting severing of the sleeve. This separating structure, in the illustrated embodiment, comprises a tear strip 41 which extends throughout the complete length of the front wall 23 so as to be joined to the opposite open ends of the sleeve. The tear strip 41 is formed in a conventional manner by a pair of perforate tear lines 42.

Referring now to FIG. 1, wherein the complete package 10 is illustrated in an inverted or upside-down condition, the outer sleeve 11 is also of rectangular cross section and is formed by substantially parallel top and bottom walls 46 and 47, respectively, joined together by substantially parallel side walls 48 and 49. The outer sleeve 11 telescopes over the inner sleeve 12 such that the longitudinal axes of these two sleeves are substantially perpendicular to one another. In this regard, the term "longitudinal axis" is defined as being the axis which extends between the open ends of the respective sleeve and is thus substantially parallel to the planar end and side walls thereof. This perpendicular telescoped relationship between the inner and outer sleeves thus results in the top and bottom walls of the outer sleeve effectively closing off the open ends of the inner sleeve, thereby preventing the individual boxes 13 from sliding out of the inner sleeve.

The bottom wall 47 of outer sleeve 11 preferably has an end portion thereof removed so as to form a recess 51, whereby a part of the bottom wall 17 of one box 13 is hence exposed. Accordingly, if the boxes 13 are labeled on the bottom wall 17, then the recess 51 permits one of the end walls to be readily observed so that an individual can readily determine the contents of the package without partially or wholly disassembling same. The recess 51, however, is normally dimensioned so that the bottom wall 47 of the outer sleeve will still partially overlap the end wall 17 to thereby securely retain the endmost box 13 within the package 10.

The outer sleeve 11, like the inner sleeve 12, is normally initially formed as a flat blank, as by being stamped from a sheet of semi-stiff paperboard or the like, which blank is then folded into a rectangular tubular configuration and has the free edges thereto adhesively secured together. Each of the inner and outer sleeves can obviously have any desired labeling printed thereon.

While the illustrated embodiment discloses the package 10 as being designed for containing six elongated boxes 13, it will be recognized that the package 10 can be easily modified so as to contain either greater or lesser numbers of said boxes or other suitable articles.

The present invention also contemplates that the outer sleeve 11 may be of such axial length (that is, the length between the open ends of the sleeve) as to permit the reception therein of two or more inner sleeves 12, with each inner sleeve containing therein a plurality of said articles. In this event, however, it may be desirable to provide the outer sleeve 12 with a girdling perforation line in the plane of the interface between the pair of adjacent inner sleeves so that the package having multiple inner sleeves can be separated into subpackages, each containing a single inner sleeve.

OPERATION

While the utilization and operation of the package 10 according to the present invention is believed self-evident from the above description, nevertheless same will be briefly described to ensure a complete understanding thereof.

To initially assemble the package 10, the plurality of articles or boxes 13 are initially slidably inserted into the inner sleeve 12 so as to assume the position substantially as shown in FIG. 2. When so positioned, the opposed hold-down flaps 31 and 32 are folded downwardly and inwardly so as to be positioned on opposite sides of the tabs 19, whereby the hold-down flaps 31 and 32 are disposed substantially in abutting engagement with the coplanar top walls 16 on the boxes 31. These hold-down flaps 31 and 32 thus maintain the plurality of boxes 13 in an aligned relationship so that the holes 21 are substantially aligned with one another. The hold-down flaps 31 and 32 also prevent the inner sleeve 12 from being slidably moved downwardly relative to the boxes beyond the position shown in FIG. 2. When so positioned, the lower ends of the boxes project beyond the lower end of the inner sleeve 12.

The outer sleeve 11 is then telescoped over the inner sleeve 12, which telescoping relationship occurs with the longitudinal axes of the two sleeves being substantially perpendicular to one another, whereupon the top and bottom walls of the inner sleeve effectively close the open upper and lower ends of the inner sleeve so as to form the assembled package, which assembled package is shown in an inverted condition in FIG. 1. This assembled package 10 results in a part of the side wall 18 and a part of the lower end wall 17 of the endmost box 13 being exposed so that the content of the individual boxes 13 can be visually observed irrespective of the manner in which the packages 10 are stacked either during shipping or storing of the packages.

When it is desired to mount the boxes 13 on the hanger rod 34 for purposes of display and sale, then the outer sleeve 12 is slidably removed from the package, thereby leaving the plurality of boxes 13 confined solely by the inner sleeve 12 in the manner illustrated in FIG. 2. At this time, the boxes 13 can be easily and conveniently individually priced, such as by having the selling price placed on each box by means of a stamp or label, which selling price is normally positioned on the exposed side wall of each box in the area generally identified as 52 in FIG. 2. This individual pricing of the boxes 13 is greatly simplified since the plurality of boxes are still securely confined by the inner sleeve 12.

Thereafter, the rear flap 36 is folded downwardly into the position shown in FIG. 3, as by manually gripping the flap and folding same outwardly so that same is severed along the side tear lines 37. If desired, the flap 36 can be folded downwardly as illustrated, or same can be completely removed by severing same along the bottom tear line 38. The hanger rod 34, as normally associated with a conventional pegboard structure, is then slidably inserted through the aligned series of openings 21 by first aligning the subpackage as shown in FIG. 2 so that the rearmost opening 21 is inserted over the free end of the rod 34, whereupon the subpackage is then moved rearwardly so as to slidably insert the rod sequentially through each of the openings 21 until all of the boxes 13 are supported on the rod. Since the plurality of boxes are all confined by the inner sleeve 12, the mounting of the plurality of boxes 13 on the rod 34 effectively comprises a single manual operation.

Figure 5:
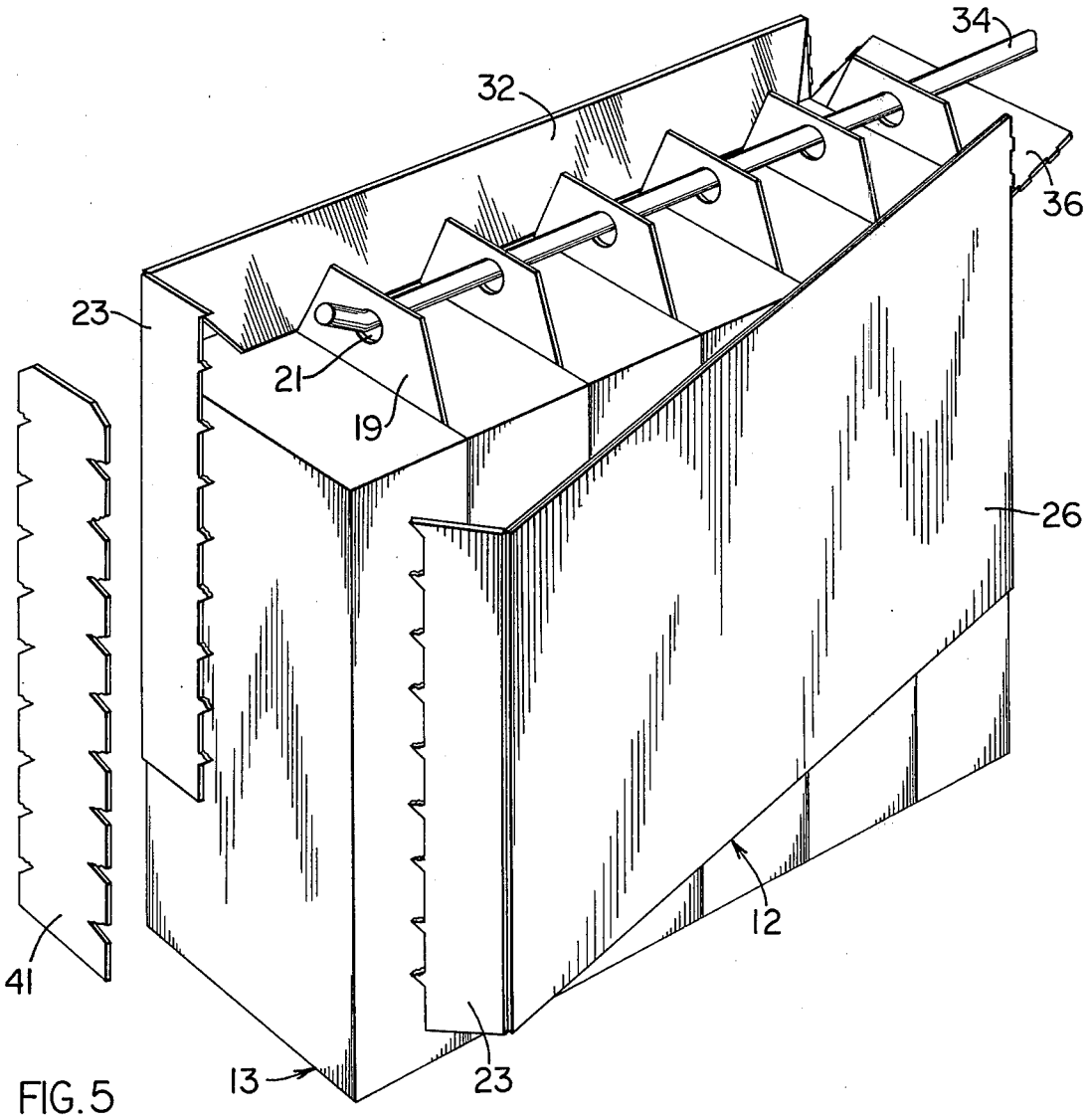
FIG. 5 is a perspective view of the package with the outer sleeve removed and with the inner sleeve opened for subsequent removal thereof, the containers in the inner sleeve being supported on a rod.

After the rod 34 has been inserted through the tabs 19 associated with the plurality of boxes 13 as described above, the upper tab 43 associated with the tear strip 41 is manually gripped and pulled downwardly, causing a severing of the tear strip 41 along the tear lines 42. This severing occurs along the complete length of the front end wall 23 and results in a complete severing of the front end wall and hence a complete severing of the inner sleeve 12 substantially as illustrated in FIG. 5. The inner sleeve 12 can then be opened up as by moving the side walls 26 and 27 laterally away from the boxes as shown in FIG. 5, whereupon the complete severed sleeve can then be moved downwardly so as to completely remove the inner sleeve 12 and thereby leave the plurality of boxes 13 hanging freely from the rod 34.

While the sequence of operations described above refers to placing the price on the individual boxes prior to hanging the boxes on the rod 34, it will be appreciated that the individual boxes 13 can also be priced or labeled after they have been positioned on the rod, but preferably prior to removal of the inner sleeve.

When the plurality of articles or boxes 13 are mounted on the rod 34 but are still confined by the inner sleeve 12, the sleeve 12 cannot be slidably displaced downwardly relative to the articles 13 due to the hold-down flaps 31 and 32 being in engagement with the top walls 16. Similarly, the sleeve 12 is prevented from moving upwardly due to the rear wall 24 thereof engaging the rod 34. Thus, the sleeve 12 can be removed only by first severing same, as by the tear strip 41, so that the side walls 26 and 27 can then be displaced laterally sidewardly away from the boxes so as to disengage the flaps 31 and 32.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a packing structure for plural elongated containers, each container having a tab projecting from one end thereof and each tab having an opening therethrough and alignable with the openings in the other tabs, the improvement which said structure comprises a first packing sleeve which includes:

a pair of parallel side walls and a pair of parallel end walls integral with and extending between corresponding lateral edges of said side walls to define a first substantially rectangular compartment with opposed opened ends, a pair of short, parallel perforation lines extending inwardly from one free edge of one end wall and adjacent the side walls whereby to form a flap which can be removed or folded sideways to expose the aligned openings in said tabs whereby an elongated element can be extended therethrough, and a pair of spaced, parallel perforation lines in one of said end walls, said perforation lines extending between the free edges thereof to define a tear strip which can be readily and manually removed whereby said first packing sleeve can be removed laterally from said containers after they are engaged by said elongated element; and said packing structure including a second packing sleeve having interconnected side walls and end walls whereby to form a second, rectangular compartment, said first sleeve with said containers therein being slidably positioned within said second sleeve so that the open ends of said first sleeve face toward the end walls of said second sleeve, and said containers are disposed completely within said second sleeve.

2. A structure according to claim 1, wherein said containers have end portions with indicia on the sides thereof, said end portions projecting from said first packing sleeve so that said indicia is exposed, and said tabs being disposed substantially completely within said first compartment.

3. A packing structure according to claim 1, wherein said first sleeve has said flap formed in said one end wall and said tear strip formed in the other end wall thereof.

4. A structure according to claim 1, wherein said second sleeve is slidably telescoped over said first sleeve in a direction which is substantially perpendicular to the axis which extends between the open ends of the first sleeve.

5. A structure according to claim 4, wherein one of the end walls of said second sleeve has a recess formed therein and extending inwardly from the free edge thereof so as to partially expose an end of one of said containers.

6. A structure according to claim 4, wherein one of the end walls of said first sleeve has a length as measured in the longitudinal direction thereof which is less than the width of the side walls of the second sleeve so that an end portion of an endmost container projects from the first sleeve and is visible through an open end of said second sleeve.

7. A structure according to claim 4, wherein said first sleeve has foldable flaps fixed to the free edge of said side walls, said flaps being foldable inwardly into the first compartment defined by said first sleeve and being positioned on opposite sides of the tabs on the containers for limiting the slidable displacement of the first sleeve relative to the containers in one direction.

8. In a packing structure for plural elongated containers, each container having a tab projecting from one end thereof and each tab having an opening therethrough and alignable with the openings in the other tabs, the improvement wherein said structure comprises an inner packing sleeve which includes a pair of parallel side walls and a pair of parallel end walls integral with and extending between corresponding lateral edges of said side walls to define a first rectangular compartment in which is positioned said containers, said inner packing sleeve cooperating with said containers for permitting an elongated element to be extended through the aligned openings in said tabs when said container are positioned relative to said elongated element;

one of the walls of said inner packing sleeve having a pair of spaced and substantially parallel perforation lines extending between the free edges thereof to define a tear strip which can be readily and manually removed to permit severing of said inner packing sleeve so that it can be removed laterally from said containers after they are engaged by said elongated element; and an outer packing member having interconnected side walls and end walls whereby to form a second rectangular compartment, said outer packing member being slidably telescoped over said inner packing sleeve with said containers being positioned therein, whereby the open ends of said inner packing sleeve face toward the end walls of said outer packing member, and said containers being disposed completely within said outer packing member.

9. In a structure for packaging a plurality of articles each having a support tab projecting from one end thereof, each tab having an opening therethrough which is alignable with the openings in the other tabs, the improvment wherein said structure comprises:

a first rectangular packing sleeve which is open at opposite ends and defines a first rectangular compartment, said first packing sleeve having said plurality of articles positioned therein in stacked or aligned relationship so that the tabs on said articles are disposed adjacent one open end of said first sleeve but are positioned within said first compartment so that the openings in said tabs are substantially axially aligned;

said first packing sleeve including a pair of substantially parallel side walls and a pair of substantially parallel end walls integral with and extending between opposite edges of said side walls, said side and end walls defining said first rectangular compartment therebetween;

one of said end walls having opening means extending inwardly from one free edge thereof, said opening means being disposed adjacent said one open end of said first packing sleeve so that said opening means is substantially aligned with said tabs whereby an elongated element can be inserted through said opening means and then through the aligned openings in said tabs;

means associated with one of the walls of said first packing sleeve for permitting severing of said one wall from one free edge thereof to the other free edge thereof so as to completely sever said first packing sleeve whereby the walls thereof can be displaced laterally outwardly away from the sides of the articles;

a second rectangular packing sleeve slidably telescoped over said first packing sleeve so that said containers are totally confined by the cooperation of said first and second sleeves, said first and second sleeves being disposed with the longitudinal axes thereof in substantially perpendicular relationship;

said second packing sleeve including a pair of substantially parallel end walls and a pair of substantially parallel side walls which are integral with and extend between the opposite edges of said end walls so as to define therebetween a second rectangular compartment in which is positioned said first sleeve and said containers, the end walls of said second packing sleeve overlying the open ends of said first sleeve, and the side walls of said second sleeve overlying the side walls of said first sleeve.

10. A structure according to claim 9, wherein said severing means is associated with the other end wall of said first sleeve.

11. A structure according to claim 9, wherein said one end wall of said first sleeve has a foldable or removable flap associated therewith and projecting inwardly from the free edge thereof, said flap being removable or foldable sidewardly away from said one end wall so as to define said opening means, and said severing means being associated with the other end wall of said first sleeve, said severing means comprising a tear strip extending across the length of said other end wall from one free edge thereof to the other free edge thereof.

12. A structure according to claim 9, wherein said first sleeve has a length as measured between the free edges of one of said side walls which is less than the overall length of said articles so that the other ends of said articles project outwardly beyond said first sleeve, and wherein said second sleeve is open at one end thereof whereby the projecting portion of the endmost article is visible through the open end of said second sleeve, said second sleeve also having recess means formed in one end wall thereof as disposed adjacent the projecting ends of said articles for exposing the endmost face of one of said articles.

13. A structure according to claim 9, wherein said first sleeve has a foldable flap fixed to and extending longitudinally along a free edge of at least one of said side walls, said flap being folded sidewardly into the first compartment adjacent the tabs on the articles and disposed substantially in abutting engagement with the upper end walls of the articles for retaining the articles in a desired position with respect to said first sleeve.

* * * * *